United States Patent [19]

Numata et al.

[11] 4,057,370

[45] Nov. 8, 1977

[54] ELECTRIC BLOWER ASSEMBLY

[75] Inventors: Shigeaki Numata; Ryosuke Sasaoka, both of Yokaichi, Japan

[73] Assignee: Matsushita Electric Industrial Co., Ltd, Kadoma, Japan

[21] Appl. No.: 646,593

[22] Filed: Jan. 5, 1976

[30] Foreign Application Priority Data

| | | |
|---|---|---|
| Feb. 4, 1975 | Japan | 50-15181 |
| Feb. 6, 1975 | Japan | 50-16015 |
| Feb. 6, 1975 | Japan | 50-16017 |
| Feb. 27, 1975 | Japan | 50-24807 |

[51] Int. Cl.[2] ..... F04B 17/00; F04D 29/66

[52] U.S. Cl. ..... 417/366; 417/369; 417/423 A; 415/119; 415/211

[58] Field of Search ..... 417/366, 369, 423 A, 417/372; 415/119, 211, 206

[56] References Cited

U.S. PATENT DOCUMENTS

| | | | |
|---|---|---|---|
| 1,350,927 | 8/1920 | Gomborow | 415/211 |
| 2,289,231 | 7/1942 | Auger et al. | 415/211 |
| 2,658,665 | 11/1953 | Tschudy | 417/423 A |
| 2,915,237 | 12/1959 | Galiulo et al. | 417/366 |
| 3,341,113 | 9/1967 | Sebok et al. | 417/369 |
| 3,791,772 | 2/1974 | Keimpema et al. | 415/211 |

FOREIGN PATENT DOCUMENTS

| | | | |
|---|---|---|---|
| 579,770 | 8/1946 | United Kingdom | 415/211 |

*Primary Examiner*—C. J. Husar

*Attorney, Agent, or Firm*—Wenderoth, Lind & Ponack

[57] ABSTRACT

Electric blower assembly wherein air expelled by centrifugal force from impellers passes through volute chambers disposed peripherally with respect to said impellers and each defining a space which is increasingly larger as the distance from the impellers increases, whereby smooth air flow is produced in the volute chambers since the speed of air flow therethrough is lessened and pressure therein becomes static pressure. From the volute chambers air passes along inclined channels and then around a drive motor, whereby the drive motor is cooled. In entering at least part of each volute chamber air from the impellers comes into contact with a volute chamber wall extension which becomes gradually lower in a direction opposing that of impeller rotation whereby noise due to contact of a volute chamber wall by all portions of the air from the impeller does not occur simultaneously and a quieter blower assembly is provided.

3 Claims, 22 Drawing Figures

FIG. 13.
FIG. 15.
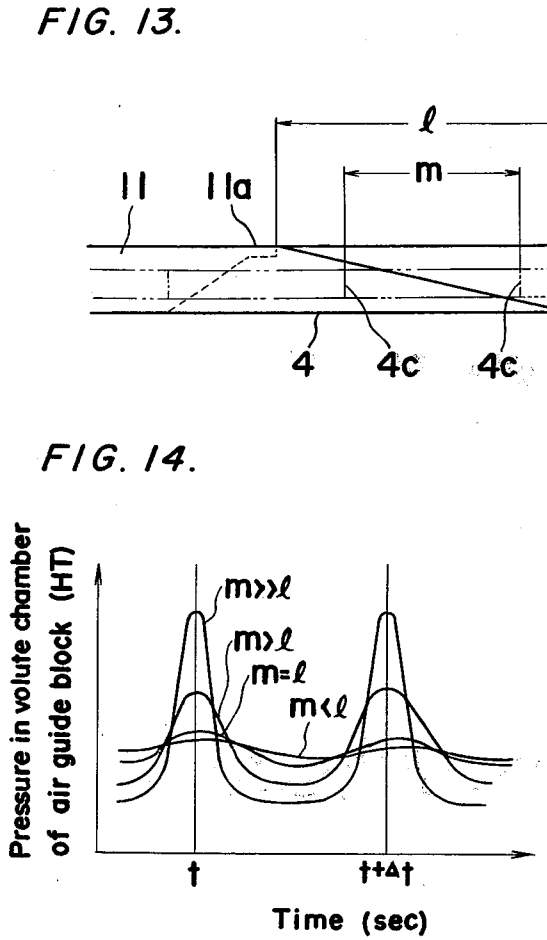
FIG. 14.
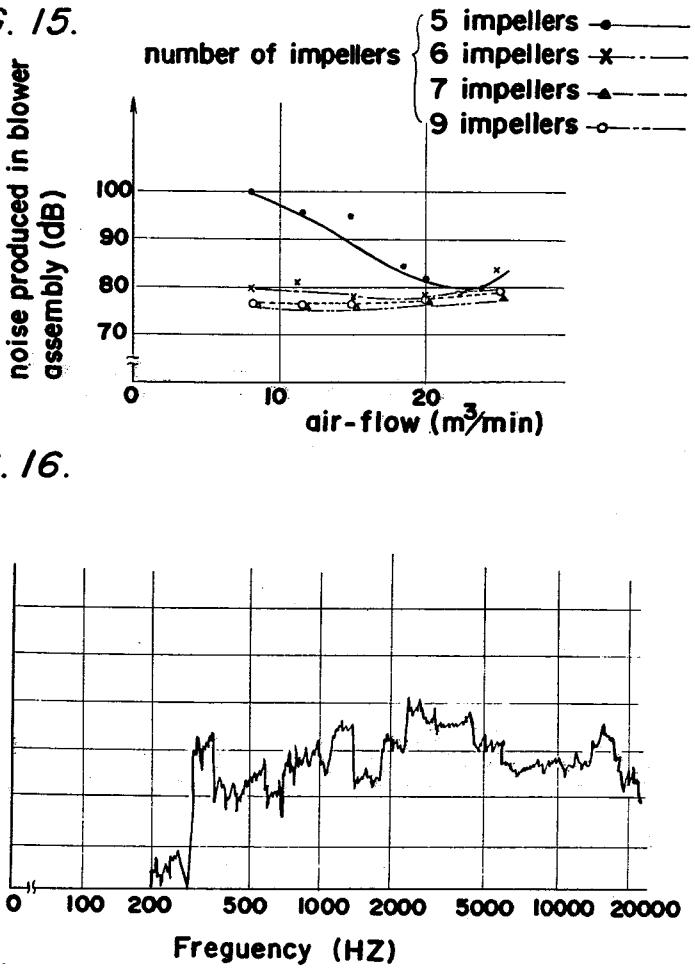
FIG. 16.

ELECTRIC BLOWER ASSEMBLY

The present invention relates to an electric blower assembly. More particularly the invention relates to an electric blower assembly having improved efficiency but a lower noise level and being suited to employment in a vacuum cleaner or similar appliance.

A problem associated with an electric blower assembly employed in a vacuum cleaner or similar household appliance is that while it must be able to create a requisite degree of vacuum in a suction compartment it must also be compact and is required to have a low consumption of electrical power. Disregarding the aspect of power consumption, size requirements for electric blower assemblies for appliances such as vacuum cleaners have generally been met and there has been made available a wide range of compact appliances which achieve the desired objects. Another problem associated with a blower assembly for use in a domestic appliance is that since the fluid medium in the blower assembly is generally air, which is compressible, the blower assembly generates a great deal of noise, which is due principally to rapid and repeated compression and decompression of air at exit ports of the blower assembly. However, there is a strong demand from users of equipment including such a blower assembly that noise level of the equipment be made lower.

A considerable contribution to resolving the problem of reducing electrical power consumption while maintaining suitably high levels of blower assembly efficiency has been made by the electric blower assembly which is disclosed in patent application Ser. No. 595,421 filed July 14, 1975 assigned to the present applicant and according to which air moving out of contact with impellers of the blower, to be subsequently used for cooling a drive motor for example, is expelled via volute chambers disposed generally peripherally with respect to the blower impellers and guide passages which avoid sudden change of direction of expelled air, whereby there are avoided locations of build-up of pressure in the blower assembly which could have an adverse effect on blower efficiency. The disclosed assembly, including the motor, has an overall efficiency higher than 40%, and for a given suction work ratio, i.e., maximum output air power of a vacuum cleaner with a flexible hose and extension wands, has an electrical power consumption which is only 80–85% that of previously developed electric blower assemblies. However, unlike a centrifugal pump which also may have similarly disposed volute chambers but which, so long as cavitation or similar effects are avoided, produces little noise other than that of moving parts since it is employed to pump water or other liquid which may be regarded as incompressible, the disclosed blower assembly while offering the above-mentioned advantages does not provide any marked advantage with respect to reduction of noise.

It is accordingly a principal object of the present invention to provide an improved electric blower assembly.

It is a further object of the invention to provide an electric blower assembly which maintains high blower efficiency but produces less noise.

It is another object of the invention to provide an electric blower assembly which is efficient, produces less noise, and is also compact.

It is yet another object of the invention to provide an electric blower assembly which is employable in a multi-stage fan assembly.

In research carried out to accomplish these and other objects, the inventors noted that the initial impact of air leaving an impeller with a volute chamber wall occurs simultaneously over all portions of an area corresponding to a vertical cross-section of the impeller, i.e., a cross-section taken through the impeller parallel to the axis about which the impeller rotates, with the result that there is addition of the noise produced at each portion of a volute chamber wall by air contacting the wall portion, and considerable total noise is produced, particularly at certain frequencies determined in reference to the number of impellers and the rotatory speed of the blower. According to the invention volute chamber walls are so formed that such simultaneous production of noise is avoided, and the relative dimensions of wall portions defining volute chambers and spacing between impeller tips are made such that pressure in each volute chamber is maintained even during the whole time an impeller passes a volute chamber and directs air thereinto, whereby blower efficiency is improved and noise is reduced.

A better understanding of the present invention may be had from the following full description thereof when read in reference to the attached drawings, in which like numbers refer to like parts, and FIG. 1 is a side view partially in section of an electric blower assembly according to one embodiment of the invention;

FIG. 13 is a schematic side view for illustration of the principles of construction of a volute chamber wall extension;

FIG. 14 is a graph of variation with time of pressure in a volute chamber of an air guide block;

FIG. 15 is a graph showing variation of production of noise in a blower assembly at different rates of air-flow for different numbers of impellers;

FIG. 16 is a graph of noise produced in a blower assembly having volute chamber walls constructed in accordance with the principles illustrated in FIG. 13;

Before proceeding with the description it is to be noted that the term vertical cross-section of an impeller or of the exhaust outlet thereof is to be taken to mean a cross-section in a plane containing the axis about which the impeller rotates, and the term 'transverse cross-section' or 'transverse dimension' to mean a cross-section or dimension along a plane or a line parallel to the plane of rotation of the impeller.

Figure 1:
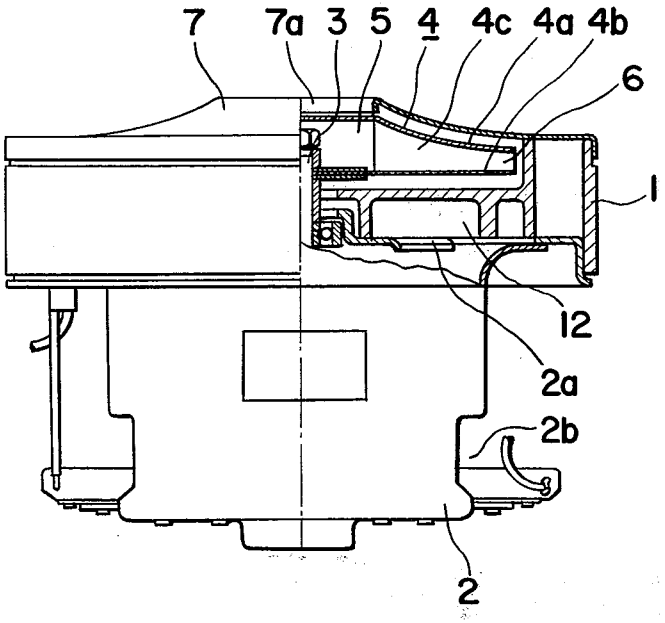
Figure 5:
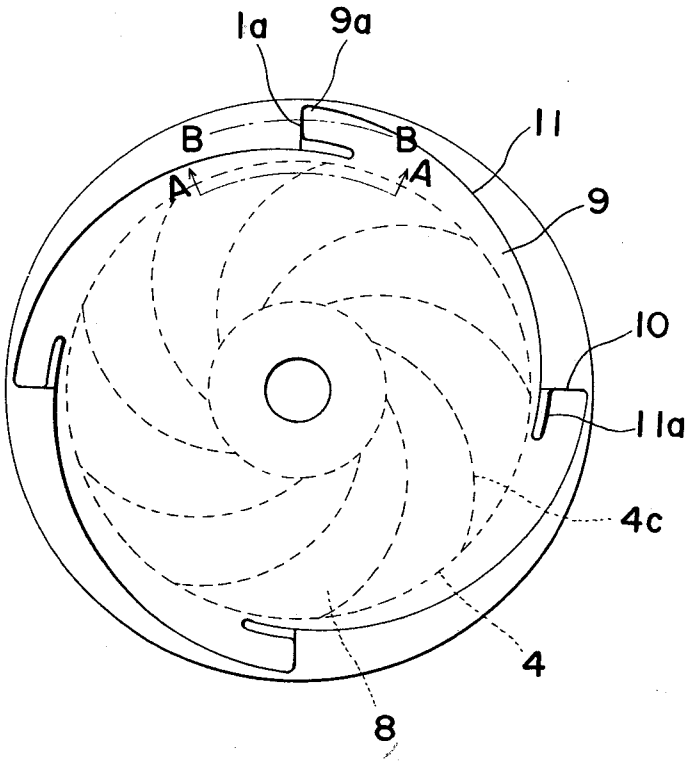
FIGS. 5 and 6 are respectively a plan view and a rear view of the air guide block of FIG. 3.

Referring to FIG. 1, there is shown an electric blower assembly including a generally circular air-guide block 1 which is in fixed attachment to the housing of a motor 2 and is disposed symmetrically with respect to the output shaft 3 of the motor 2. The air guide block 1 defines a central open space 8 of which the side opposite to the motor 2, i.e., the upper side thereof as seen in the drawings, is enclosed by a cover 7 having peripheral edge portions in airtight, fixed attachment to outer edge portions of the air guide block 1, and in which there is accommodated an air draft unit comprising an impeller 4, fixedly mounted on the motor output shaft 3. In the drawings the air guide block 1 and impeller 4 are shown as being mounted vertically above the motor 2, it being understood that other mounting positions relative to the motor 2 are equally possible. The impeller 4 is constituted by vanes 4c which are provided between a pair of opposed plates 4a and 4b, plate 4b being disposed on a plane normal to the axis of the motor output shaft 3, and plate 4a being nearer to the outer end of output shaft 3, being inclined towards the plate 4b and nearer thereto at the outer end of the impeller 4, whereby the impeller 4 has a generally funnel-shaped vertical cross-section. The profile of the cover 7 is generally parallel to that of the impeller plate 4a. In a central portion of the cover 7 there is formed a hole 7a through which air may pass and enter the impeller 4 via an opening 5 formed in the center of plate 4a, air thus entering the impeller 4 being moved through the impeller 4 due to centrifugal force when the impeller 4 is rotated and exiting therefrom via an exhaust outlet 6 defined at the impeller tip.

Figure 2:
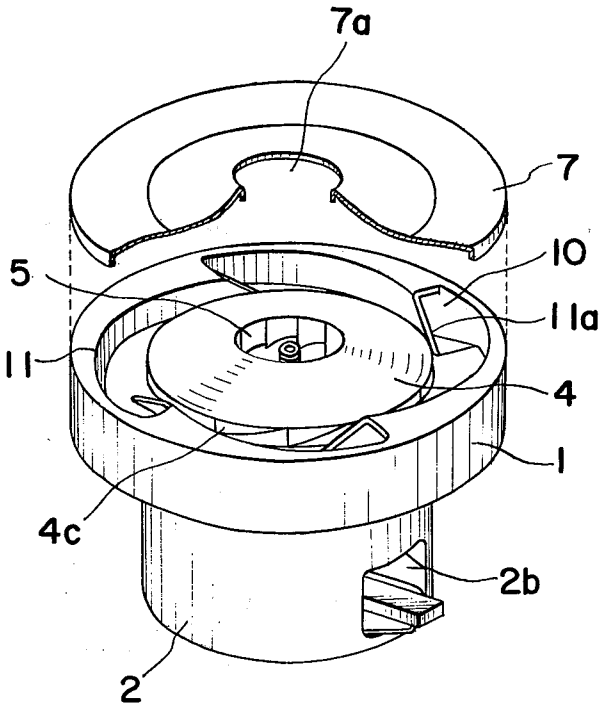
FIG. 2 is an exploded view showing the main portions of the assembly of FIG. 1.

Referring also to FIG. 2, air exiting from an impeller 4 enters a volute chamber 9 defined by the air guide block 1, passes through the volute chamber 9, exits therefrom via a channel 10 formed at the end thereof, and enters an air distribution passage 12, there being a plurality of independent passages 12 which are provided below the air guide block 1 and are in correspondence to individual volute chambers 9. From each distribution passage 12 air passes through an opening 2a leading to the motor housing, and after passing around and cooling the motor 2 exits from the blower assembly via one or more outlets 2b formed in the lower portion of the motor 2 housing.

Figure 3:
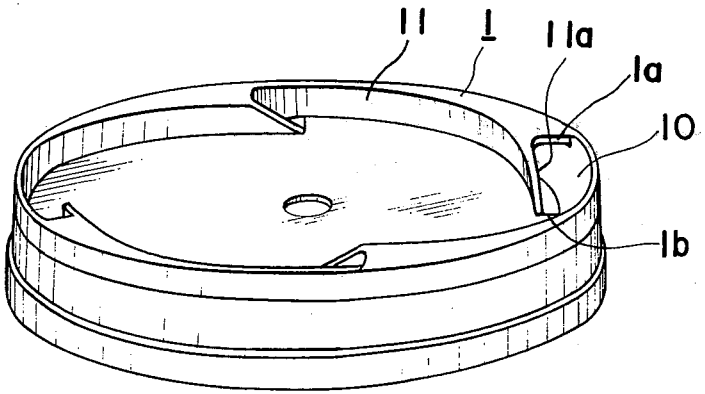
FIG. 3 is a perspective view of an air guide block.
Figure 4:
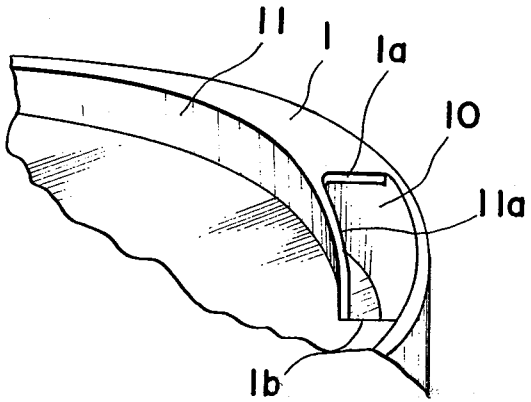
FIG. 4 is an enlarged perspective view of a portion of the air guide block of FIG. 3.
Figure 7:
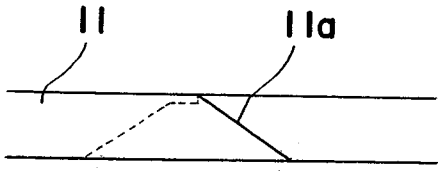
FIG. 7 is a cross-sectional view taken along the line A — A of FIG. 5.

Sudden change of direction of air exiting from the impeller chamber 8 is avoided by providing suitably inclined paths therefor as may be appreciated from FIGS. 3 through 6 to which reference is now had. Each volute chamber is defined by air guide block portions 1a and 1b, a wall 11 and an extension 11a of the volute chamber wall 11 of the next volute chamber 9', i.e., the volute chamber which is next reached subsequent to volute chamber 9 by an impeller 4 during rotation thereof. The vertical dimension of the wall 11 is greater than that of the tip of the impeller 4, whereby air exiting over the entire vertical cross-section of the impeller exhaust outlet 6 will be deflected by the wall 11. The extension 11a of each wall lies innermost with respect to the air guide block 1, adjacent to the path travelled by tips of impellers 4 during rotation thereof, and the wall 11 extends from the extension 11a, with a definite radius of curvature, towards the outer wall of the air guide block 1, terminates at a point adjacent to the outer wall of the block 1, and is connected to the wall extension 11a' of the next volute chamber wall 11' by an air guide block upper wall portion 1a. The entire lower surface of the volute chamber 9 is defined by an air guide block lower wall portion 1b. The curvature of the wall 11 need not be constant over the entire length thereof but may be changed over one or more portions thereof. As best illustrated in FIGS. 3 and 4, and also shown schematically in FIG. 7, the extension 11a of each wall 11 is not of constant height but is inclined downwards from the inner side of the corresponding air guide block upper wall portion 1a to the inner side of the corresponding air guide block lower wall portion 1b, i.e., in the direction of rotation of impellers 4 each wall extension 11a gradually increases in height, to a maximum height equal to the height of a main wall 11. With this construction therefore air driven through an impeller 4 due to centrifugal force and exiting therefrom via the exit 6 thereof (see FIG. 1)is driven into an increasingly larger space defined by a volute chamber 9. Because the air thus expelled enters an increasingly larger space the air is allowed to expand and the pressure thereof steadily becomes static pressure as the air progresses further into the volute chamber 9. Air exits from each volute chamber 9 via an exit channel 10 which communicates with an air distribution passage 12 and is formed at the outer end portion of the volute chamber 9, i.e., the end portion thereof whch is outermost with respect to the motor output shaft 3 and which is reached last by air entering the volute chamber 9.

Figure 8:
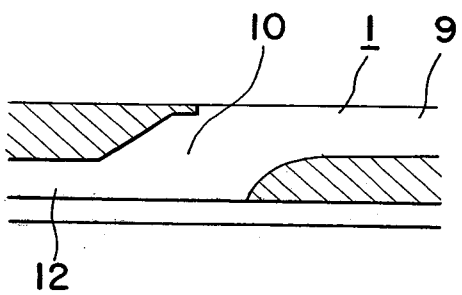
FIG. 8 is a cross-sectional view taken along the line B — B of FIG. 5.
Figure 6:
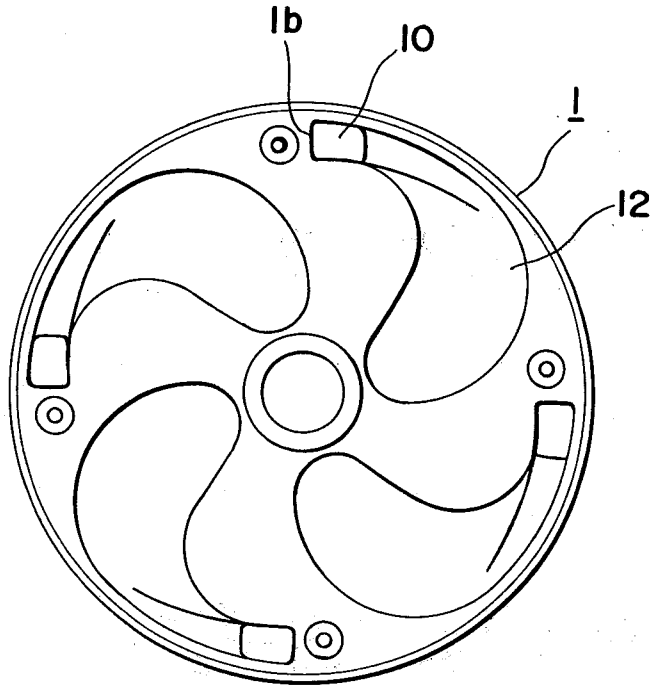

As shown most clearly in FIG. 8 each exit channel 10 between a volute chamber 9 and a distribution passage 12 is an inclined channel along which air may flow from the chamber 9 to the passage 12. Thus, since there is no sudden change of direction of air flow, and also since air at the outer end of the volute chamber 9 is under more or less static pressure, air flows smoothly into the distribution passage 12 and there is no undesirable back-loading liable to adversely effect blower efficiency. Still under static pressure, air passes from the distribution chamber 12 via a port 2a, cools the motor 2 and then is exhausted from the motor 2 housing via an exhaust port 2b, as noted above.

Figure 12:
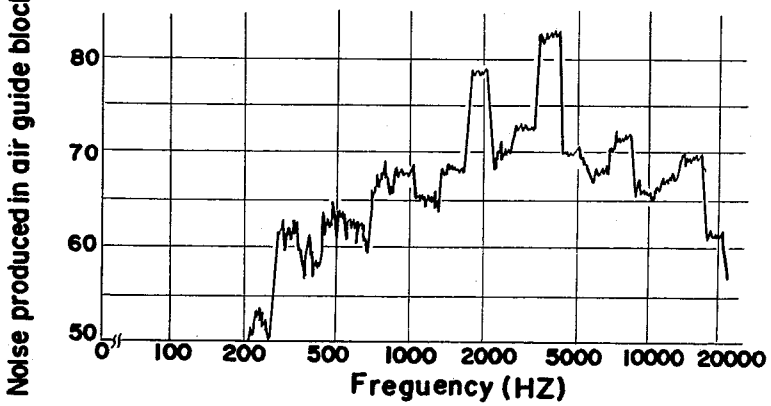
FIG. 12 is a graph of sound produced in the air guide block of FIG. 9.
Figure 9:
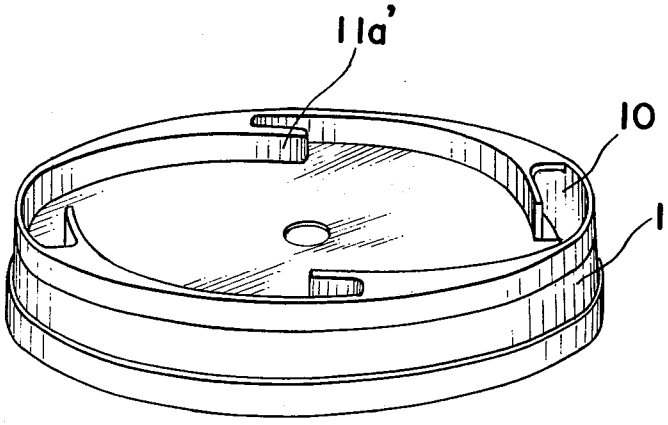
FIG. 9 is a perspective view of an air guide block according to the above described prior copending application including volute chambers having wall extensions.
Figure 10:
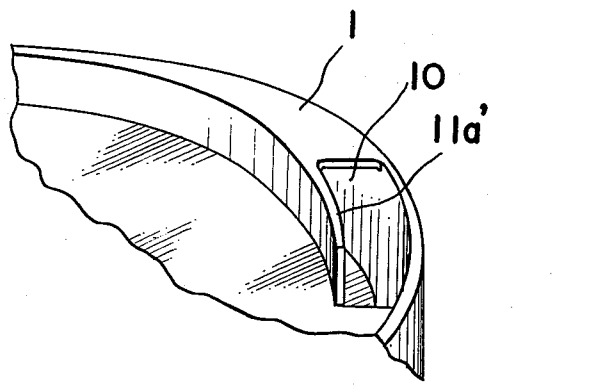
FIG. 10 is an enlarged perspective view of a wall extension of a volute chamber of the air guide block of FIG. 9.

Considering now the aspect of noise produced by the blower assembly, if each volute chamber wall 11 has an inner extension 11a', such as shown in FIGS. 9 and 10, which is unchanged in vertical cross-section and thus presents a wall of constant height to the tip of a rotating impeller 4, contact of the volute chamber wall inner extension 11a' by air exiting from each portion of the exhaust outlet 6 of the impeller 4 occurs simultaneously over the entire vertical cross-section of the outlet 6. In other words, since noise is produced by the initial contact of each portion of air exiting from the impeller 4 with a portion of the wall extension 11a', and since this initial contact occurs simultaneously for all portions of air exiting over the entire vertical cross-section of the exhaust opening 6, both when the opening 6 first reaches the wall extension 11*a'* and during the time the entire transverse cross-section of the impeller opening 6 is moved past the wall extension 11*a'*, the noise produced by each portion of air is combined with that produced by each other portion of air, resulting in production of a considerable amount of noise each time the impeller opening 6 passes the wall extension 11*a'*, the same of course applying to other impeller openings and other wall extensions 11*a'*. For a typical blower which has six blades and is rotated at 20000 rpm, such noise is produced at the entry to each volute chamber at a frequency of $(20000 / 60) \times 6 = 2000$ times per second. Test results, which are plotted in FIG. 12, show that there is a peak of noise produced at a frequency of 2000 Hz and that for a blower assembly having volute chamber wall extensions 11*a'* such as as shown in FIGS. 9 and 10 this peak approaches 80 dB. There is also a peak at 5000 Hz, which for this type of blower assembly exceeds 80 dB.

In contrast to this, in a blower assembly according to the invention which has inclined volute chamber wall extensions 11*a* such as shown in FIGS. 3 and 4 and described above when an impeller opening 6 passes a volute chamber 9 there is not simultaneous contact of the wall extension 11*a* by air exiting from all portions of the impeller exhaust opening 6, and instead, since air exiting from different portions of the exhaust outlet 6 strike the wall extension 11*a* at different times as the impeller 4 is moved past the extension 11*a*, there is a time-wise distribution of the noise produced by exiting air striking the wall extension 11*a*. Due to this, as can be seen from the test results plotted in FIG. 11, the peaks of noise produced at the frequencies of 2000 Hz and 5000 Hz are much lower.

Referring now to FIGS. 13 and 14, in which the dimension 1 indicates the length of an inclined volute chamber wall extension 11*a* such as described above and the dimension *m* indicates the distance between one vane 4*c* and the next vane 4*c'*, if one vane 4*c* passes a particular point of the wall extension 11*a* at time *t*, the next vane 4*c'* passes the same point at time $t + \Delta t$, $\Delta t$ being 1/2000 second for a blower having six vanes and rotated at a speed of 20000 rpm. As each exhaust outlet 6 passes a volute chamber air is expelled from the exhaust outlet 6 into each volute chamber causing production of pressure $H_T$ in the volute chamber, the pressure $H_T$ produced, and more particularly variations thereof, in turn causing production of noise. Depending on the relation between length *l* of a volute chamber wall extension 11*a* and the inter-vane distance *m* the variation of pressure in a volute chamber 9 during rotation of impeller 4 is plotted in FIG. 14, from which it may be seen that whereas there is a considerable momentary build-up of pressure when inter-vane distance *m* is greater than wall extension length *l*, there is very little build-up when inter-vane distance *m* and wall extension length *l* are equal, and there is an extremely even pressure distribution in the volute chamber during discharge thereinto of air from successive exhaust outlets when inter-vane distance *m* is smaller than the wall extension length *m*. The reason for even pressure distribution in this last case is that air begins to be discharged into a volute chamber 9 by a following exhaust outlet when or before discharge of air into the volute chamber 9 by the preceding exhaust outlet finishes, resulting in a general evening-out of air discharge into the volute chamber 9. The reason why there is not complete elimination of pressure peaks when inter-vane distance *m* and wall extension length *l* are equal is that since the height of the wall 11 is greater than that of an impeller outlet 6, even if distance *m* and length *l* are made equal, distance *m* is effectively greater than length *l*.

Variation of production of noise when the number of vanes 4*c* in a blower is varied, which is equivalent to changing inter-vane distance *m*, is shown in the graph of FIG. 15. From FIG. 15 it is seen that provision of five vanes results in an extreme increase of noise for most rates of air flow.

Figure 11:
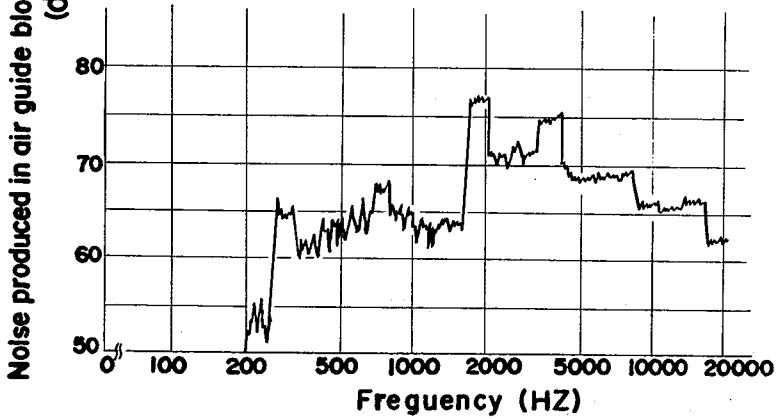
FIG. 11 is a graph of sound produced in an air guide block according to the invention.

FIG. 16 is a graph of production of noise in a blower in which inter-vane distance *m* is less than the length *l* of a volute chamber wall extension. From the graph it is seen that when this relation between distance *m* and length *l* is maintained, at a blower frequency of 2000 Hz there is production of much less noise than in a blower having a conventional construction for which production of noise at different frequencies is shown in FIG. 12, and that there is also improvement with respect to reduction of noise compared to the blower for which production of noise is shown in FIG. 11. Thus by maintaining a precise relationship according to the invention between dimensions of volute chamber walls and inter-vane distance, a blower assembly having a much quieter action is obtained.

Figure 18:
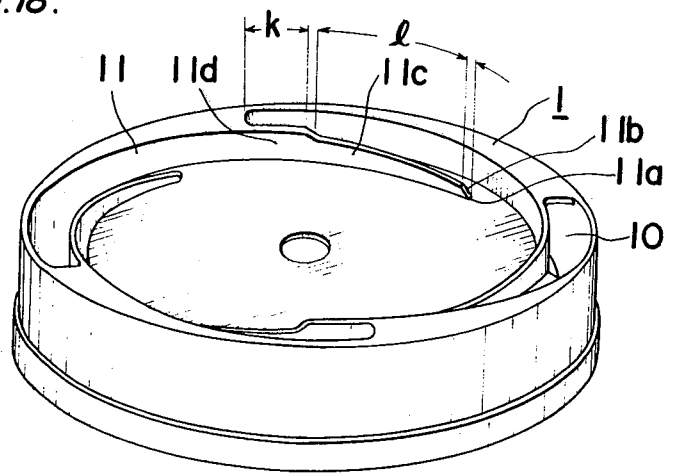
FIGS. 17 and 18 are respectively a plan view and a perspective view of a blower assembly having volute chambers constructed according to another embodiment of the invention.
Figure 19:
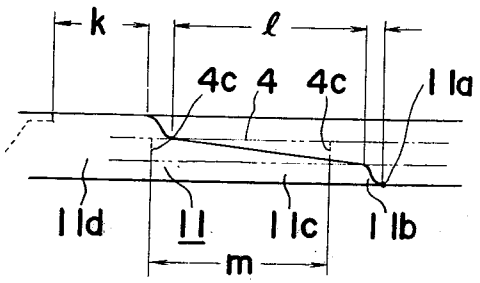
FIG. 19 is a schematic side view for illustration of the principles of construction of volute chamber walls of the assembly of FIG. 17.
Figure 17:
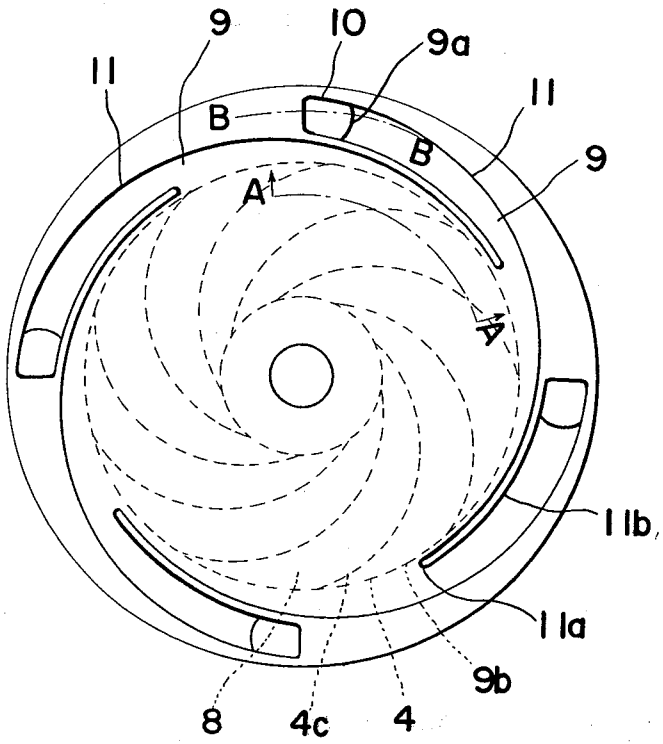

The same object may be achieved by a blower assembly having the construction shown in FIGS. 17 through 19, to which reference is now had. In this embodiment of the invention, the extension of each volute chamber wall is made considerably longer than in the above described embodiment, a considerable portion of each volute chamber being defined between a wall extension and a main wall portion. As best shown in FIGS. 18 and 19, each wall extension 111 comprises an end point 111*a*, a main inclined portion 111*c* which has a length *l* generally equal to inter-vane distance *m* and increases in height in the direction of rotation of impeller 4, and a gently sloped portion 111*b* which joins end point 111*a* to the main inclined portion 111*c* and is designed to avoid brusque change of direction from the volute chamber floor 1*b*. The slope of the inclined portion 111*c* is generally equal to the ratio of the vertical dimension of an impeller outlet 6 to the length *l* of the inclined portion 111*c*. The inclined portion 111*c* is joined by another gently sloped portion 111*b'* to a straight portion 111*d* which has the same height as and joins directly to the main portion of the volute chamber wall 111 and constitutes an inner wall at the outer end of the adjacent volute chamber 9, i.e., the end thereof which connects to the outlet port 10. The straight wall portion 111*d* acts as an enclosure which promotes increase of pressure at the outlet end of the volute chamber 9. The inclined portion 111*c* permits reduction of sound produced by the blower assembly, but the length *k* of the straight portion 111*d* relative to the length *l* of the inclined portion 111*c* is such that the greater portion of the volute chamber 9 is defined by wall portions having a height equal to that of the main wall 111, i.e., a height slightly greater than the vertical dimension of an impeller outlet 6, whereby efficiency of the blower assembly is improved. It has been found that the blower assembly having the construction shown in FIGS. 17 through 19 shows an improvement of approximately 3.5% in blower efficiency.

Figure 20:
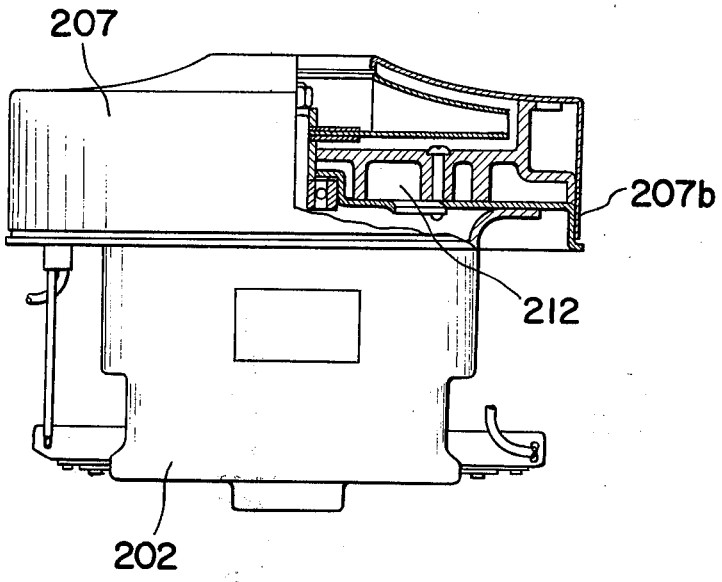
FIG. 20 is a side view partially in section of an electric blower assembly according to another embodiment of the invention.
Figure 21:
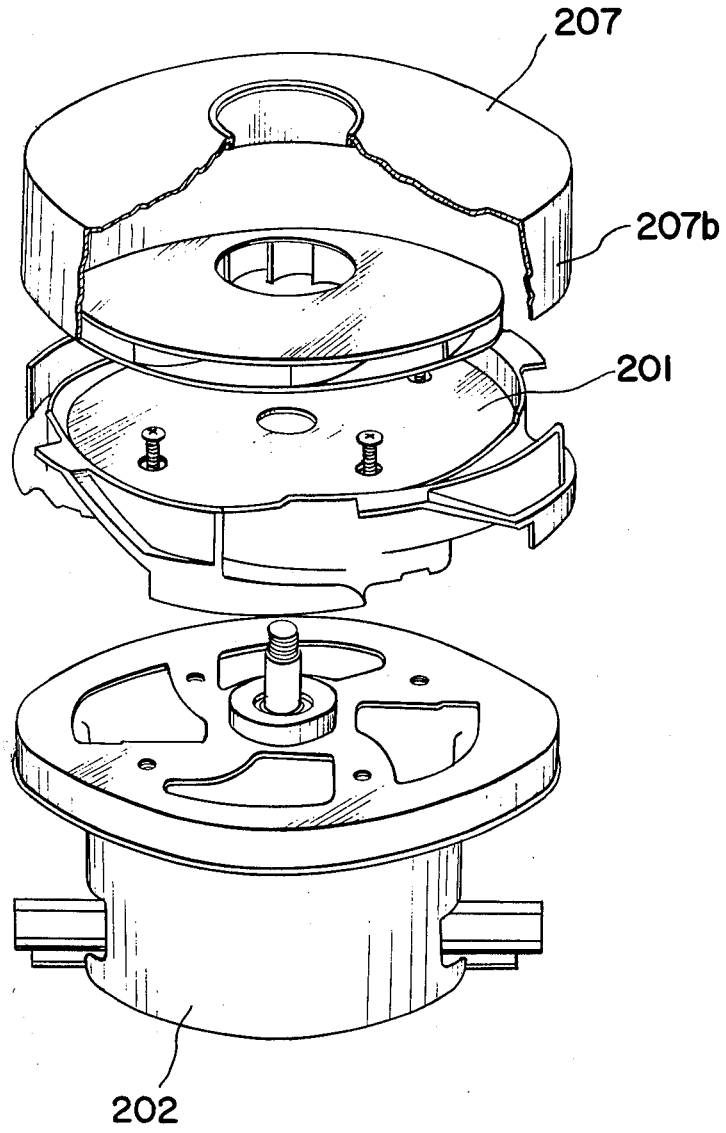
FIG. 21 is an exploded view showing the main parts of the assembly of FIG. 20.

According to another embodiment of the invention shown in FIGS. 20 and 21, the lower, outer circumferential portions of an air guide block 201 are cut away and the air guide block 201 is fitted between a cover 207 and a motor housing 202, the cover 207 having a vertical, downwardly extending side wall **207*b* which surrounds the outer periphery of the air guide block 201. In this embodiment, portions leading to distribution passages 212 for guiding cooling air to around the drive motor 2 are defined between the air guide block 201 and the inner surface of the cover side wall 207*b*. This construction has the advantage that since the outer portion of the air guide block 201 is effectively constituted by the side wall 207*b* and side wall 207*b*** may be made of metal plate or similar strong but thin material, the assembly as a whole may be made lighter and more compact.

Figure 22:
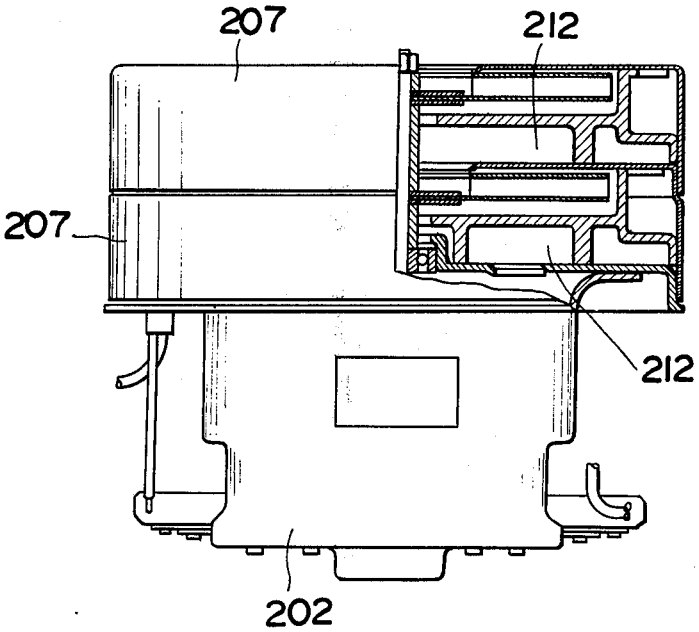
FIG. 22 is a side view partially in section of a double stage electric blower assembly.

In another embodiment of the invention shown in FIG. 22, a blower assembly comprises two impellers 304 and associated air guide blocks 301 which are provided in vertical relationship to one another along the axis of the output shaft of the drive motor 2. Air expelled from the upper block passes through the air exhaust distribution passages 312 thereof into the impeller opening 305 of the lower block and air from the lower block is employed to cool the drive motor 2. In this embodiment, each block has a volute chamber construction such as described above, due to which blower assembly action is comparatively quiet, despite the fact that a high vacuum is produced.

What is claimed is:

1. An electric blower assembly comprising at least one impeller having a plurality of vanes thereon defining exhaust outlets therebetween, an electric motor on which said impeller is mounted for rotation of said impeller, a plurality of volute chambers which are disposed peripherally around and on the plane of rotation of said impeller and each of which is defined by wall portions disposed parallel to and on opposite sides of said plane of rotation of said impeller, by a main wall disposed between said wall portions and perpendicular to said plane of rotation and extending in a curve having an inner end which is closer to said impeller and an outer end which is further removed from said impeller, and by a wall extension which in each volute chamber extends in direct continuation from the inner end of the main wall of an adjacent volute chamber and has the upper edge inclined downwardly in a direction opposite the direction of rotation of said impeller, the length of each said wall extension being greater than the distance between adjacent impeller vanes, air distribution passages for direction of air around said motor, whereby said motor may be cooled, and channels which are inclined with respect to said plane of rotation of said impellers and extend between outer end portions of said volute chambers and said air distribution passages.

2. An electric blower assembly comprising at least one impeller having a plurality of vanes thereon defining exhaust outlets therebetween, an electric motor on which said impeller is mounted for rotating said impeller, air distribution passages for direction of air around said motor, whereby said motor may be cooled, and an air guide block which at least partially encloses said impeller and defines a plurality of volute chambers which are disposed peripherally with respect to said impellers, each of said volute chambers having a wall portion forming part of said air guide block and being generally parallel to and the plane of rotation of said impeller, a main wall which is disposed normally to said plane of rotation, is curved, extends from an inner point adjacent to said impellers to an outer point further removed from said impellers, and has a height at least equal to the height of said exhaust outlets, and by a wall extension in each volute chamber which faces and in said plane of rotation overlaps said main wall and defines an enclosure wall portion which is equal in height to and is in direct continuation to the inner end of the main wall of the adjacent volute chamber subsequently reached by said impellers during rotation thereof, and an inclined portion which is a continuation of said enclosure wall portion and slopes downwardly in a direction opposite the direction of rotation of said impellers, and has a length generally equal to the distance between adjacent vanes, said main wall and wall extension forming part of said air guide block, said air guide block further having therein channels which are inclined with respect to said plane of rotation and connect said air distribution passages and end portions of said volute chambers further removed from the axis of rotation of said impellers, said inclined channels being open along the periphery of said air guide block and a cover provided over said impellers and said air guide block completing the volute chambers and having a depending side wall extension constituting the outer periphery of said guide block and closing said inclined channels.

3. Electric blower assembly as recited in claim 2, wherein there is provided a plurality of said air blocks and impellers, said blocks and impellers being disposed along said axis of rotation.

* * * * *